United States Patent [19]

Mertens et al.

[11] 4,089,283

[45] May 16, 1978

[54] METALLIC CONTAINER AND METHOD FOR MAKING THE SAME

[75] Inventors: Marc Frans Mertens, Landskouter; Bernard Wantiez, Mariakerke, both of Belgium

[73] Assignee: Rheem Manufacturing Company, New York, N.Y.

[21] Appl. No.: 780,680

[22] Filed: Mar. 23, 1977

[30] Foreign Application Priority Data

| | | |
|---|---|---|
| Jun. 21, 1976 | Belgium | 255122 |
| Jan. 11, 1977 | Belgium | 255580 |

[51] Int. Cl.[2] ..... B21D 51/30

[52] U.S. Cl. ..... 113/120 K; 113/120 Y; 220/67; 220/378

[58] Field of Search ..... 113/19, 120 K, 120 Y, 113/1 E, 30; 220/67, 378

[56] References Cited

U.S. PATENT DOCUMENTS

| | | | |
|---|---|---|---|
| Re. 29,307 | 7/1977 | Wessely | 113/120 R |
| 2,362,846 | 11/1944 | O'Brien | 113/120 Y |
| 2,986,319 | 5/1961 | Bierman et al. | 220/67 |
| 3,774,560 | 11/1973 | Hartz | 113/120 Y |
| 3,882,763 | 5/1975 | Ellerbrock | 113/120 Y |
| 4,010,703 | 3/1977 | Spiekermann et al. | 113/120 Y |

*Primary Examiner*—Michael J. Keenan

*Attorney, Agent, or Firm*—Watson, Leavenworth, Kelton & Taggart

[57] ABSTRACT

The cover for a metal container has a first quantity of sealing material applied to an extent of its flange and the flange is pre-curled. The cover is assembled with a drum with the first quantity sealing material juxtaposed with a flange of the drum. The drum and cover flanges are wound jointly with a second quantity of sealing material continuous with the first quantity sealing material.

5 Claims, 5 Drawing Figures

METALLIC CONTAINER AND METHOD FOR MAKING THE SAME

The present invention basically applies to metallic containers of the type consisting of a cylindrical body and bottoms crimped by winding of the peripheral edges of the said body and bottom and/or cover.

The characteristic features of the invention refer more in particular (but not exclusively) to containers of large capacity, e.g., drums of 100 to 200 liters.

By the very reason of these large capacities, the said containers present a contact between the bottom and body elements over a very substantial area.

The examination of photographic enlargements of the radial section of such a crimping, well known in itself, and more particularly as shown in FIG. 6 of the Belgian Pat. No. 418,665, industrialized by the assignee hereof, reveals that it is difficult, if not practically impossible, to ensure a free, regular and continuous contact between the various metal thicknesses as exist alternately on the adjacent edges of the drum body and on the adjacent edges of the bottom or the cover.

The connection between the body and the bottom and/or cover thus implies that one should be assured not only of a large number of crimping folds, but also of additional arrangements capable of tolerating certain sliding movements of adjacent local parts, respectively of the body and the cover and bottom, during — even severe — impacts, without endangering the tightness.

Moreover, it would seem that the authors of the previous patents relating to crimping between the body and the bottom or cover, have almost exclusively been considering this question of tightness.

In a general manner, the latter problem was solved by introducing between the adjacent parts of the body and the bottom or cover, an annular joint generally located in a portion of the crimping.

The object of the present invention is a metallic container of the aforementioned type, but with the characteristic that after the crimping operation, the said sealing element is designed in such a manner as to present several concentric and alternate layers in the crimping.

In a preferred embodiment, the said crimping is such that it presents seven metal thicknesses alternating with a plurality of layers of annular elements simultaneously forming an air seal and a deformable packing, pro rata of the relative movements, if any, among the various metal thicknesses within the crimping. In so doing an alternation is obtained among at least five metal thicknesses and three thicknesses of a relatively elastic material.

The sealing product may consist of a natural or synthetic rubber material, well known in itself.

In the making of metallic containers, the invention provides for introduction of first and second quantities of sealing material at different times in the course of assembling a drum and its cover to provide sealed crimped connection of flanges thereof. In a preferred practice, the cover flange is preliminarily wound and the first quantity of sealing material is applied thereto during such winding to form a layer contiguous with the curled cover flange. The cover is then permitted to stand until the sealing material applied thereto decreases in flowability to achieve a relative set. The cover is next applied in interfitting relation with the as yet unwound drum radial flange and the second quantity of sealing material is introduced upon the first quantity sealing material into and adjacent the space betweeen the drum and cover radial flanges as they are jointly wound such that the fully crimped connection thereof has a continuous layer of sealing material contiguous with and intermediate the fully wound flanges. Such second application of sealing material may be accomplished by spray injection and the material is dispersed between the flange surfaces by centrifugal force generated by rotation of the drum and cover in a seaming or winding machine.

By way of non-limiting examples, practices and embodiments are described below with reference to the attached drawings.

Figure 1:
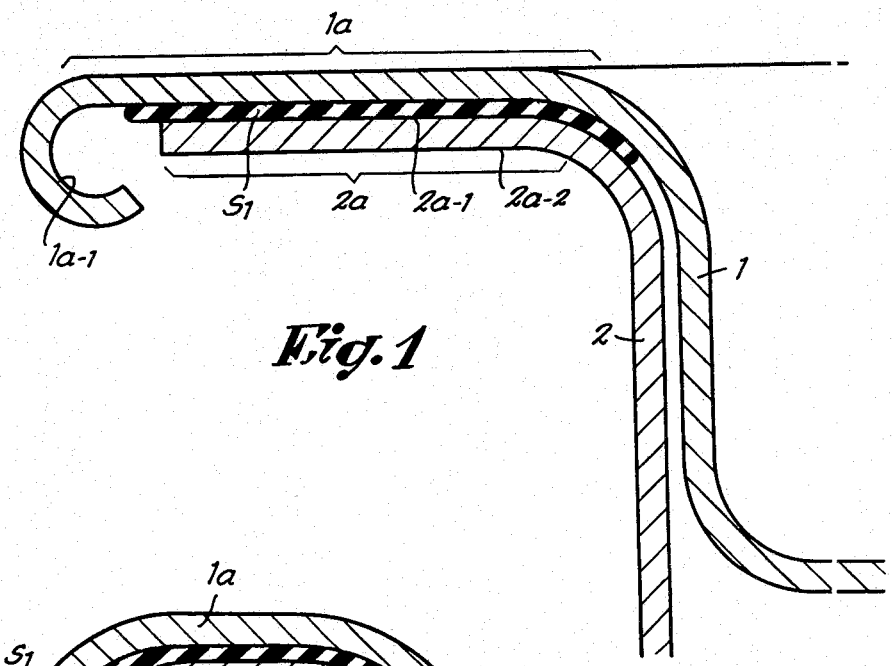
FIG. 1 is a sectional view, taken radially, of the completed container assembly.

Referring to the completed assembly of the invention in FIG. 1, the peripheral edge of the bottom or cover 1 and the portion juxtaposed on the corresponding portion of the adjacent edge of the body of the drum 2 are wound at the same time as the layer forming the sealing element, in such a manner that the resulting crimping presents seven metal thicknesses 3–9, alternating with at least three to five thicknesses of a sealing material, respectively 10–4.

In so doing, a crimping is obtained in which the contact area of metal on metal is for a large part replaced by a contact of metal on sealing material.

This embodiment can be applied in shapes that are basically variable pro rata of the number of crimping folds, of the number of thicknesses of sealing material, and of the nature of the utilized sealing material.

It can be seen that contrary to the conventional embodiments of crimping with air seal, the latter is not confined to a relatively restricted portion of the crimping, but is designed in such a manner as to present a maximum contact area with the metal. Moreover, the layers of sealing material are applied at a height which adjoins the height of the crimping.

It results from this novel concept that the sealing material participates much more in the crimping, by ensuring a satisfactory tightness, as well as a crimping in which the metal folds may possibly absorb certain relative movements, e.g. in case of accidental impacts. These possible relative movements are such that, even in case of permanent deformation — of course within certain given limits — a contact continuity is maintained between the metal thicknesses and the layers of sealing material.

Figure 2:
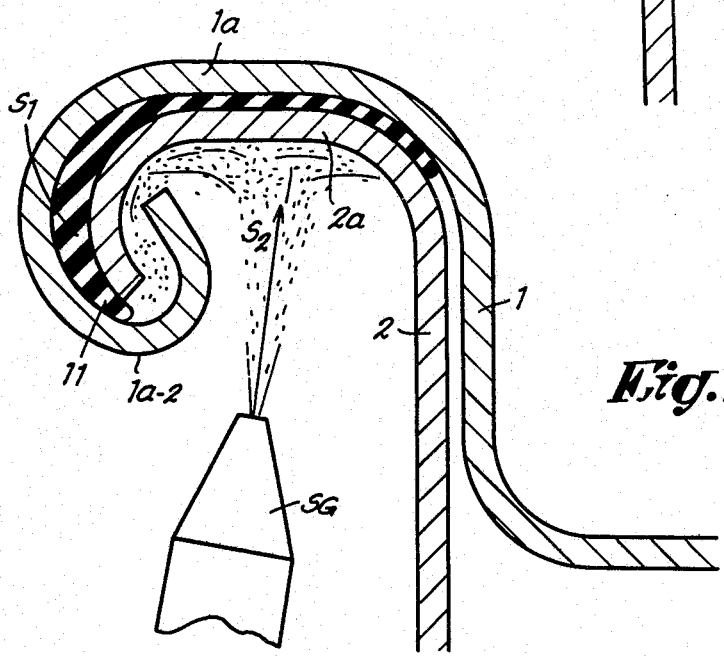
FIGS. 2–4 are sectional views of the drum and cover in assembly according with the preferred practice of the invention.
Figure 3:
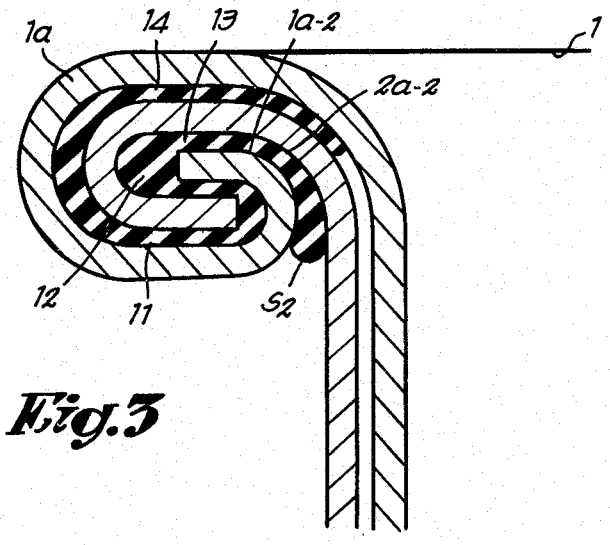
Figure 4:
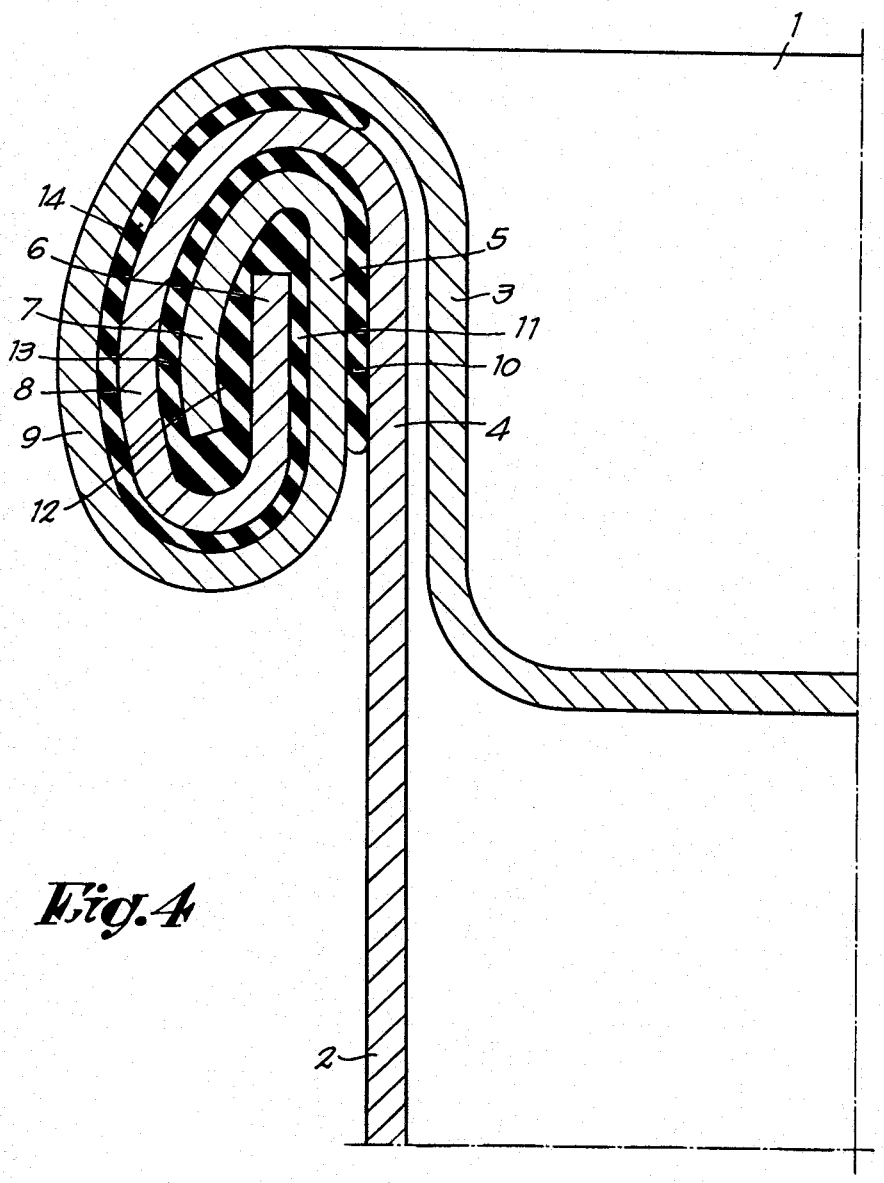

In reaching the complete assembly of FIG. 1, cover 1 is wound or curled at its flange 1*a*, to the extent (exceeding 180°) as shown in FIG. 2, while unassembled with drum 2. The precurled cover has a first quantity of sealing material $S_1$ applied in flowable state to flange interior surface 1*a*-1 during such curling. Next, after sealing material quantity $S_1$ exhibits a preselected decrease in flowability and forms sealing material thickness 11, the cover is assembled with the flange 2*a* of drum 2 with sealing material quantity $S_1$ facing drum flange surface 2*a*-1 as shown in FIG. 2, the flanges 1*a* and 2*a* are jointly wound, as shown in transition in FIGS. 3 and 4 to the final crimped connection of FIG. 1. A second quantity $S_2$ of sealing material is introduced in the course of such joint flange winding, as shown in FIG. 3, contiguous with the relatively set sealing material quantity $S_1$ and with the opposing flange surfaces, forming sealing material thickness 12 successive to thickness 11 and thickness 13 successive to thickness 12. The final phase of joint winding of the flanges forms sealing material thickness 10.

Figure 5:
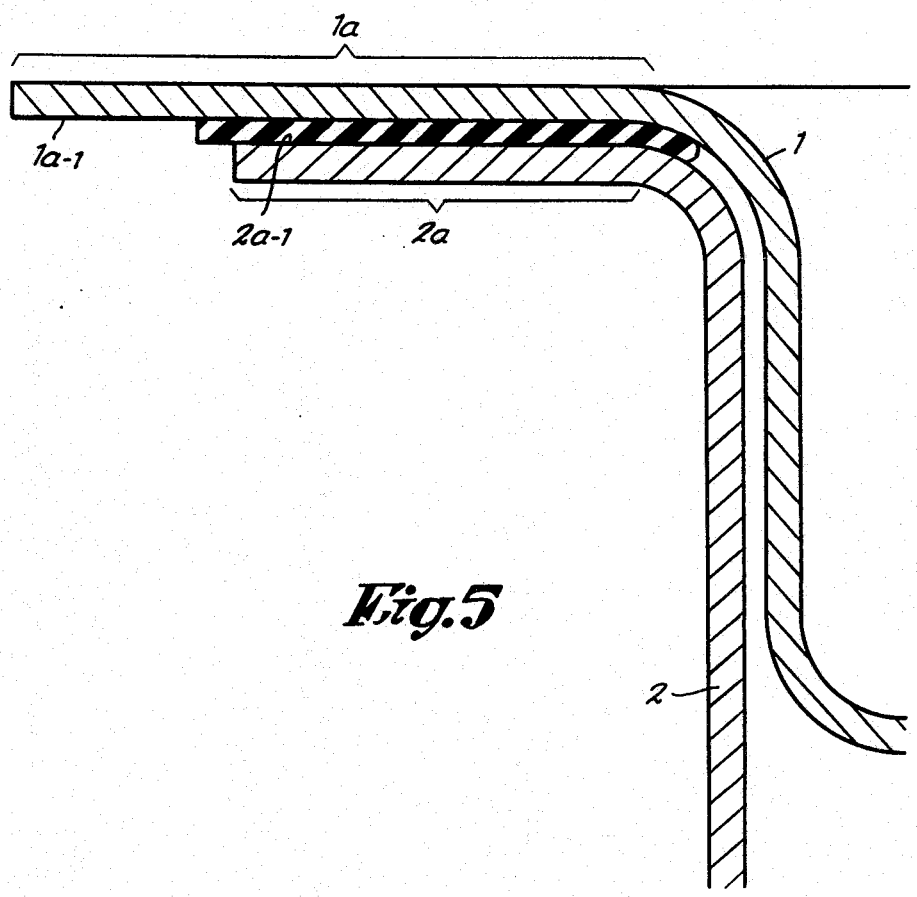
FIG. 5 is a sectional view of the drum and cover in assembly according with an alternative practice of the invention.

In an alternate practice shown in FIG. 5, cover 1 and drum 2 are disposed as indicated with flange 1*a* of cover 1 having radial extent beyond that of flange 2*a* of drum 2 and having the first quantity $S_1$ of sealing material previously applied to and set upon cover flange surface 1*a*-1. Flange 1*a* is now wound or curled initially, as shown in FIG. 2, such that flange 2*a* is intermediate successive courses of flange 1*a*. Such preliminary winding of the flanges, practiced as shown in FIG. 2, is now continued as in FIGS. 3 and 4 with sealing material quantity $S_2$ being introduced as above discussed.

The pre-curled (FIG. 2) or uncurled (FIG. 5) cover flange is preferably permitted to stand, before assembly with the drum, for a sufficient periiod of time to affect a decrease in the flowability of sealing material quantity $S_1$ from its degree of flowability at the time of its application to flange surface 1*a*-1 such that the first quantity material $S_1$ is not displaced within the flanges upon introduction and winding of the second quantity material $S_2$. In the case of natural or synthetic rubber material, a standing period of several hours is sufficient. As will be appreciated, in use of sealing materials having a gelling or relative setting facility which is faster than that of natural or synthetic rubber, the setting time period may be reduced from such several hour period.

In introducing the sealing material quantities in the described practices, spray injection techniques are effective and are practiced by use of spray gun SG (FIG. 3) with the spray being applied over somewhat more than the entire circumference of the flanges. In winding the flanges in a customary seaming machine, the later introduced sealing material is desirably dispersed between the flange surfaces by centrifugal force generated upon rotation of the cover and drum by the seaming machine.

The invention refers to metallic containers and more particularly to all metallic drums in which the bottoms or covers are fixedly connected with the body of the container by crimping according to the invention.

We claim:

1. The method of joining a cover to a drum to form a sealed container comprising the steps of:
   (a) applying a first quantity of sealing material in first flowability state to a flange of said cover;
   (b) after said first quantity of sealing material exhibits a preselected second flowability state decreased from said first flowability state thereof, placing a flange of said drum in facing relation with said first quantity of sealing material; and then
   (c) introducing a second quantity of said sealing material in said first flowability state contiguous with such first quantity sealing material between said cover flange and said drum flange while jointly winding said drum and cover flanges.

2. The method claimed in claim 1 wherein said step (a) is practiced while said cover flange is preliminarily wound.

3. The method claimed in claim 2 wherein said cover flange is wound through an angle exceeding 180° in such preliminary winding.

4. The method claimed in claim 1 wherein said drum is rotated whereby said second quantity sealing material is dispersed between said flanges by centrifugal force.

5. The container made by the practice of the method of claim 1.

* * * * *